US008992349B2

(12) United States Patent
Begnoche

(10) Patent No.: US 8,992,349 B2
(45) Date of Patent: Mar. 31, 2015

(54) FOOTBALL THROWING TRAINING DEVICE

(71) Applicant: Kenneth R. Begnoche, Boynton Beach, FL (US)

(72) Inventor: Kenneth R. Begnoche, Boynton Beach, FL (US)

( * ) Notice: Subject to any disclaimer, the term of this patent is extended or adjusted under 35 U.S.C. 154(b) by 235 days.

(21) Appl. No.: 13/758,112

(22) Filed: Feb. 4, 2013

(65) Prior Publication Data

US 2013/0210557 A1 Aug. 15, 2013

Related U.S. Application Data

(60) Provisional application No. 61/594,146, filed on Feb. 2, 2012.

(51) Int. Cl.

| | |
|---|---|
| ***A63B 69/00*** | (2006.01) |
| ***A63B 65/12*** | (2006.01) |
| ***A63B 71/14*** | (2006.01) |

(52) U.S. Cl.

CPC ..... *A63B 69/002* (2013.01); *A63B 65/12* (2013.01); *A63B 71/148* (2013.01); *A63B 2209/10* (2013.01)

USPC ..... 473/438

(58) Field of Classification Search

USPC ..... 473/438, 422, 450; 2/161.6, 18, 19, 20; 30/123.5; D29/123, 120.1, 117.1

See application file for complete search history.

(56) References Cited

U.S. PATENT DOCUMENTS

| | | | | | |
|---|---|---|---|---|---|
| 19,018 | A | * | 1/1858 | Cohen | 30/123.5 |
| 183,045 | A | * | 10/1876 | Dunlop | 441/58 |
| 275,780 | A | * | 4/1883 | Mahar | 224/217 |
| 601,982 | A | * | 4/1898 | Peirson | 224/170 |
| 633,220 | A | * | 9/1899 | Sholl | 30/123.5 |
| 690,302 | A | * | 12/1901 | Lee | 2/20 |
| 1,161,020 | A | * | 11/1915 | Bobbitt | 30/123.5 |
| 1,790,381 | A | * | 1/1931 | Keller | 602/64 |
| 1,970,081 | A | * | 8/1934 | Eisendrath | 126/204 |
| 2,154,197 | A | * | 4/1939 | Callaway | 2/159 |
| 2,251,027 | A | * | 7/1941 | Baker | 2/16 |
| 3,124,806 | A | * | 3/1964 | Campbell et al. | 2/160 |
| 3,149,839 | A | * | 9/1964 | Materia | 473/59 |
| 3,496,573 | A | * | 2/1970 | Joseph et al. | 2/161.6 |
| 3,581,312 | A | * | 6/1971 | Nickels | 2/159 |
| 3,712,288 | A | * | 1/1973 | Weiss | 126/206 |
| 3,750,348 | A | * | 8/1973 | Johnson | 451/523 |
| 3,890,649 | A | * | 6/1975 | Diggins | 2/20 |
| 3,908,197 | A | * | 9/1975 | Griffin | 2/20 |
| 3,918,096 | A | * | 11/1975 | Lim | 2/161.1 |
| 4,042,975 | A | * | 8/1977 | Elliott et al. | 2/19 |
| 4,247,097 | A | * | 1/1981 | Schwartz | 482/105 |
| 4,330,120 | A | * | 5/1982 | Netti | 482/105 |
| 4,670,909 | A | * | 6/1987 | Forrester | 2/160 |
| 4,700,405 | A | * | 10/1987 | Sternberg | 2/161.1 |

(Continued)

*Primary Examiner* — Gene Kim
*Assistant Examiner* — M Chambers
(74) *Attorney, Agent, or Firm* — Robert M. Downey, P.A.

(57) ABSTRACT

A device for training users to utilize proper mechanics when throwing a football includes an open-ended glove having a slot communicating with a compartment that is sized to receive an arched insert plate. When the glove is worn by a user, the arched insert plate permits flexion of the user's wrist while preventing extension of the user's wrist, unless sufficient force is applied. When throwing a football, the arched insert plate prevents the user's wrist from improperly extending backwards during the follow-through motion of throwing a football. A padded spacer is included on the surface of the palmar portion of the glove for encouraging the user to properly grip the football using primarily his or her fingertips.

20 Claims, 5 Drawing Sheets

(56) References Cited

U.S. PATENT DOCUMENTS

| | | | | | |
|---|---|---|---|---|---|
| 4,958,384 | A * | 9/1990 | McCrane | 2/161.6 |
| 5,640,712 | A * | 6/1997 | Hansen et al. | 2/20 |
| 5,898,938 | A * | 5/1999 | Baylor et al. | 2/20 |
| 5,924,136 | A * | 7/1999 | Ogean | 2/159 |
| 6,105,162 | A * | 8/2000 | Douglas et al. | 2/20 |
| 6,226,795 | B1 * | 5/2001 | Winningham | 2/20 |
| 6,643,845 | B2 * | 11/2003 | O'Dea et al. | 2/161.6 |
| 7,451,496 | B2 * | 11/2008 | Carey et al. | 2/160 |
| 2002/0148031 | A1 * | 10/2002 | O'Dea et al. | 2/160 |
| 2005/0066404 | A1 * | 3/2005 | Barker | 2/20 |
| 2009/0229035 | A1 * | 9/2009 | Van Hale | 2/161.6 |
| 2012/0117704 | A1 * | 5/2012 | Hofeldt | 2/20 |
| 2013/0210557 | A1 * | 8/2013 | Begnoche | 473/438 |

* cited by examiner

FOOTBALL THROWING TRAINING DEVICE

This patent application is based on provisional patent application Ser. No. 61/594,146 filed on Feb. 2, 2012.

BACKGROUND OF THE INVENTION

1. Field of the Invention

The present invention relates to athletic training devices and, more particularly, to a device that trains a user to use proper technique for obtaining optimal velocity and accuracy when throwing a football.

2. Discussion of the Related Art

When throwing a football, it is desirable for the football to have a tight spiral wherein the football rotates about its long axis with as many revolutions per minute as possible. Generally, a football thrown with a tight spiral has greater accuracy and velocity upon leaving the thrower's hand than a football thrown without a tight spiral. Proper football throwing mechanics require a series of movements that are unlike the movements involved in throwing a spherical ball, such as a baseball, and can be difficult to learn and commit to muscle memory.

When throwing a football, it is necessary for the thrower to prevent his or her wrist from bending backwards (extension) during the football throwing motion, particularly as the football is being released during the follow-through motion. Extension of a thrower's wrist during the throwing action promotes improper technique and results in a poorly thrown spiral. At the same time, however, it is necessary for the thrower's wrist to be capable of bending forwards (flexion) during the follow-through motion (i.e. the moment immediately following release of the football), as proper throwing technique requires pronation of the thrower's wrist during the follow-through portion of the football throwing motion.

Previous attempts directed towards devices used for teaching proper football throwing mechanics, such as training football described in U.S. Pat. No. 6,722,889, have failed to provide a training device which effectively assists a user in learning the proper follow-through technique necessary to achieve a tight spiral. While wrist devices have been developed to prevent a user's wrist from bending backwards, such as the bowling glove described in U.S. Pat. No. 4,608,720, these wrist devices utilize plates that are too rigid and would likely cause injury to a user's hand or wrist if the user were to attempt to break his fall using his hands, which is a likely occurrence when playing football. Moreover, these glove devices with rigid plates do not allow flexion (i.e. bending forwards) of the wrist during the follow-through motion which is necessary for proper football throwing technique.

In view of the shortcomings associated with existing football throwing training devices, there is a need for a device for training throwers to utilize proper mechanics when throwing a football which discourages extension of the thrower's wrist while also permitting flexion of the thrower's wrist when throwing a football.

SUMMARY OF THE INVENTION

The present invention is directed to a device for training users to utilize proper mechanics when throwing a football and includes an open-ended glove having a slot sized to receive an arched insert plate. When the glove is worn by a user, the arched insert plate permits flexion of the user's wrist while restricting extension of the user's wrist, unless sufficient force is applied. When throwing a football, the arched insert plate restricts the user's wrist from improperly extending backwards during the cocking phase, the intermediate acceleration phases, and the follow-through phase of the football throwing motion. A padded spacer is included on the surface of the palm portion of the glove for encouraging the user to properly grip the football using primarily his or her fingertips.

BRIEF DESCRIPTION OF THE DRAWINGS

For a fuller understanding of the nature of the present invention, reference should be made to the following detailed description taken in conjunction with the accompanying drawing in which.

Like reference numerals refer to like referenced parts throughout the several views of the drawings.

DETAILED DESCRIPTION OF THE PREFERRED EMBODIMENTS

Referring to the several views of the drawings, the football throwing training device of the present invention is shown and generally indicated as 10.

Referring to FIGS. 1-7D, the football throwing training device 10 includes an open-ended glove 12 having no finger or thumb compartments. The device 10 is sized to be fitted onto a user's throwing hand in a wrapping action. A top side of the glove 12 covers the dorsal side of a portion of the user's hand and wrist, and a bottom side of the glove 12 covers the palmar side of the user's hand and wrist. The glove 12 may be manufactured to be worn by right-handed throwers, as shown in FIGS. 1-7D, or left-handed throwers. The glove 12 is secured to the user's hand and wrist by straps 14A, 14B and 14C, which wrap partially about the user's hand or wrist and releasably secure to the main body of the glove 12 using hook and loop fasteners 16, or any other suitable releasable and adjustable fastener. In an alternative embodiment of the training device 10, the glove 12 is at least partially constructed of elastic material and is securable to a user's hand by stretching the glove 12 around and onto the user's hand.

The glove 12 may be formed of any flexible material that is suitable for being worn by a user while throwing a football. It is preferred that the material be machine washable and dryable so that the glove 12 can be easily cleaned after use. In the preferred embodiment, as shown in FIGS. 1-7D, the material on the outer surface of the glove 12 serves as the loop portion of the hook and loop fasteners 16 for releasable engagement with hook material on the bottom side of the straps 14A, 14B and 14C. Alternatively, designated loop portions of the hook and loop fasteners 16 could be included on the outer surface of the glove 12. It is also preferable that the glove 12 to be comprised of a breathable material that is water-resistant to increase the glove's durability and comfort when worn by a user.

Figure 1:
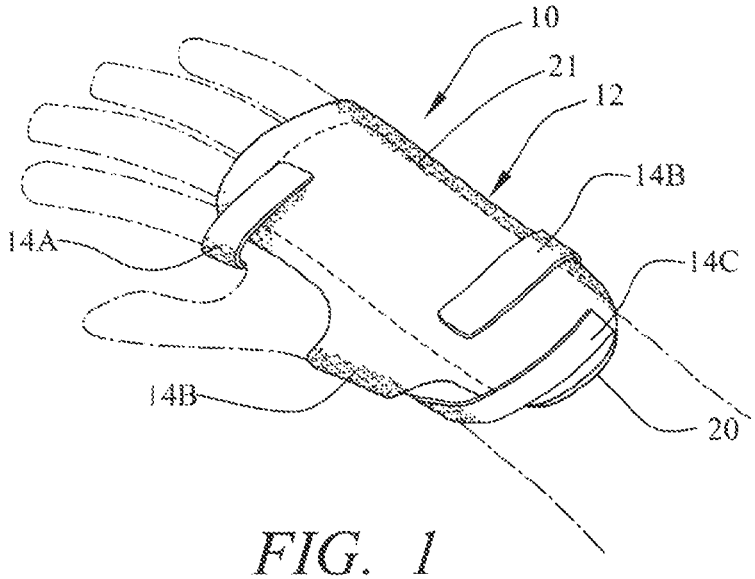
FIG. 1 is a perspective view of the football throwing training device, shown on a user's right hand.
Figure 2A:
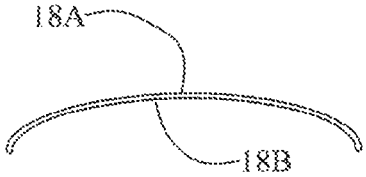
FIG. 2A shows a cross-sectional view of the arched insert plate shown in FIG. 2 and taken along line 2A-2A.
Figure 2:
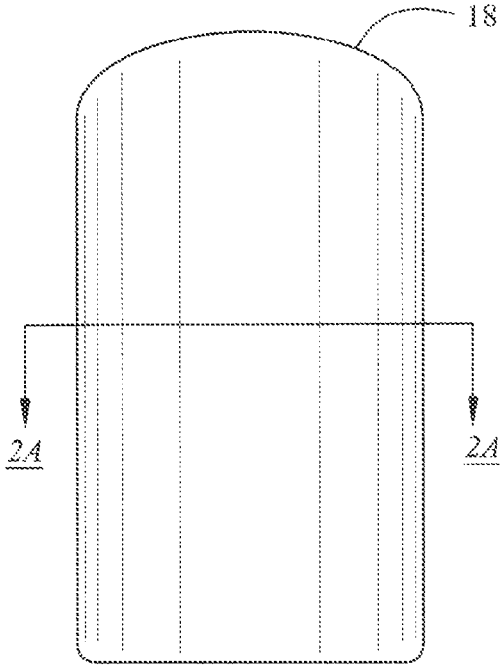
FIG. 2 is a top side view of the arched insert plate.
Figure 3:
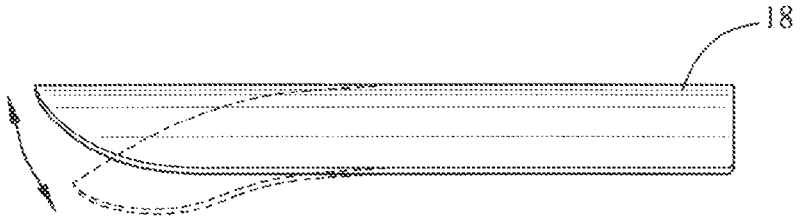
FIG. 3 is an elevated side profile view of the arched insert plate illustrating the flexion movement of the arched insert plate.
Figure 4:
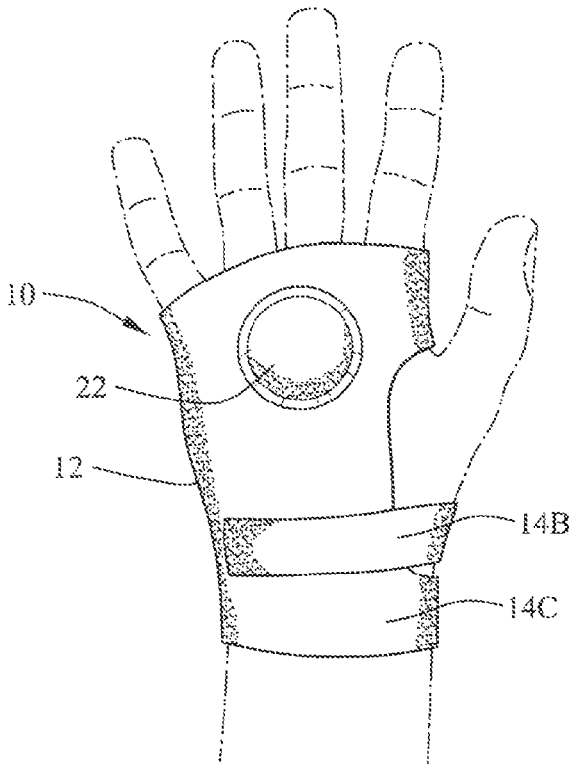
FIG. 4 is a bottom side view of the football throwing training device, shown on a user's right hand.
Figure 5:
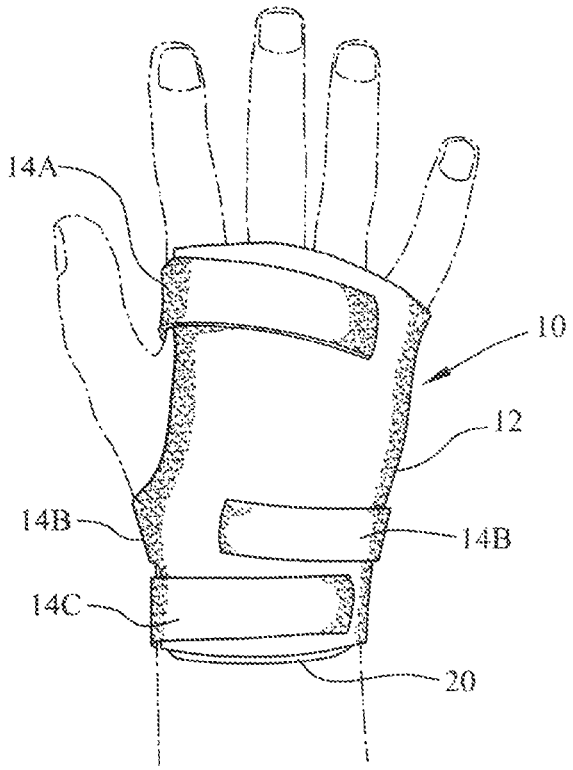
FIG. 5 is a top side view of the football throwing training device, shown on a user's right hand.
Figure 6:
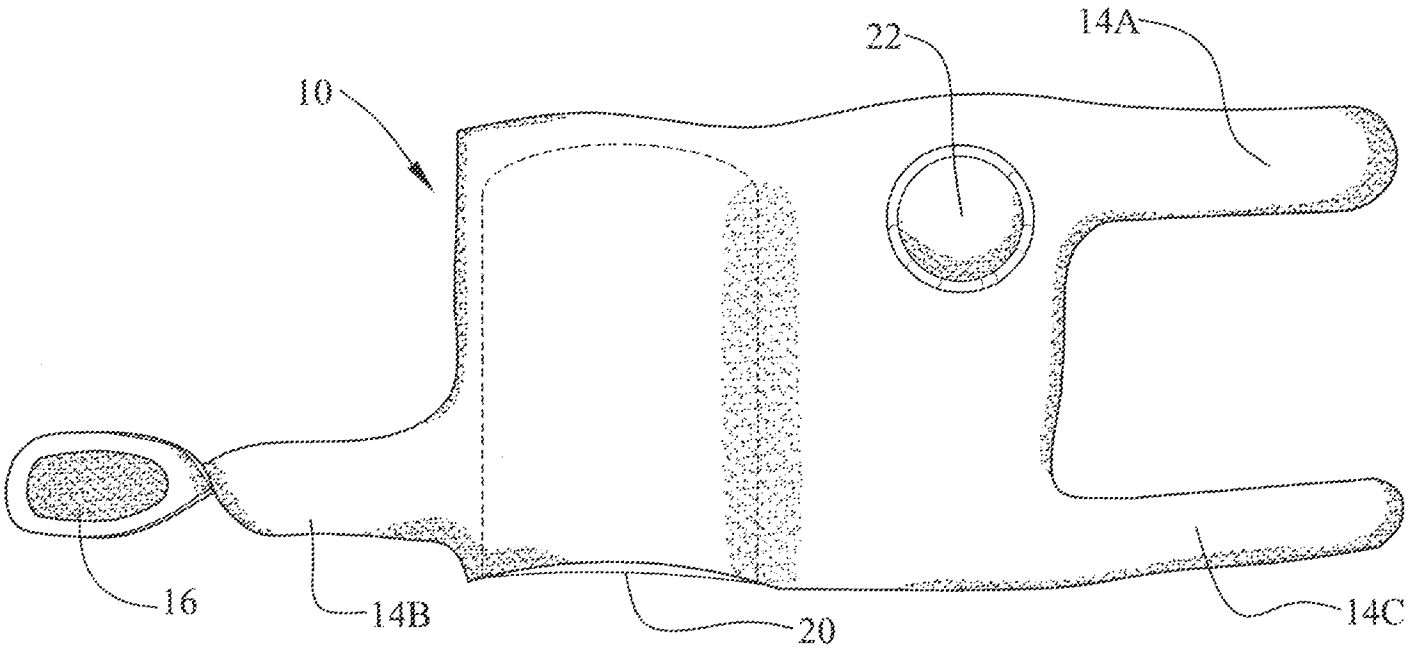
FIG. 6 is a top side view of the football throwing training device, shown apart from a user's hand and with unsecured straps.

Referring to FIGS. 2-3, an arched insert plate 18 having a convex top surface 18A and a concave bottom surface 18B is sized for insertion into a receiving slot 20 located at the base of the glove 12 and into a compartment 21. When inserted into the compartment 21 via the receiving slot 20, the curvature of the arched insert plate 18 (illustrated in FIG. 2A) is structured to permit flexion of a user's wrist, as the plate 18 can bend in the forward direction (as illustrated in FIG. 3) with relative ease; however, without sufficient force, the plate 18 prevents a user's wrist from extending backwards. The arched insert plate 18 is structured to give way to extension of a user's wrist only where sufficient force is applied (e.g. when bracing oneself when falling to the ground) in order to prevent injury, which is a greater force than the force required to bend the plate 18 in the forward direction due to the curvature of the insert plate 18. Consequently, when worn by a user, the device 10 restricts the user from improperly extending his or her wrist backwards (extension) when throwing a football, as the force experienced during such movement is not great enough to bend the plate 18 in the backwards direction.

Multiple arched insert plates 18 may be used to increase the resistance to both extension and flexion of the user's wrist, while still permitting flexion with minimal force. In a preferred embodiment, between one and three arched insert plates 18 are used to vary the resistance to extension of the user's wrist during the football throwing motion.

Figure 7A:
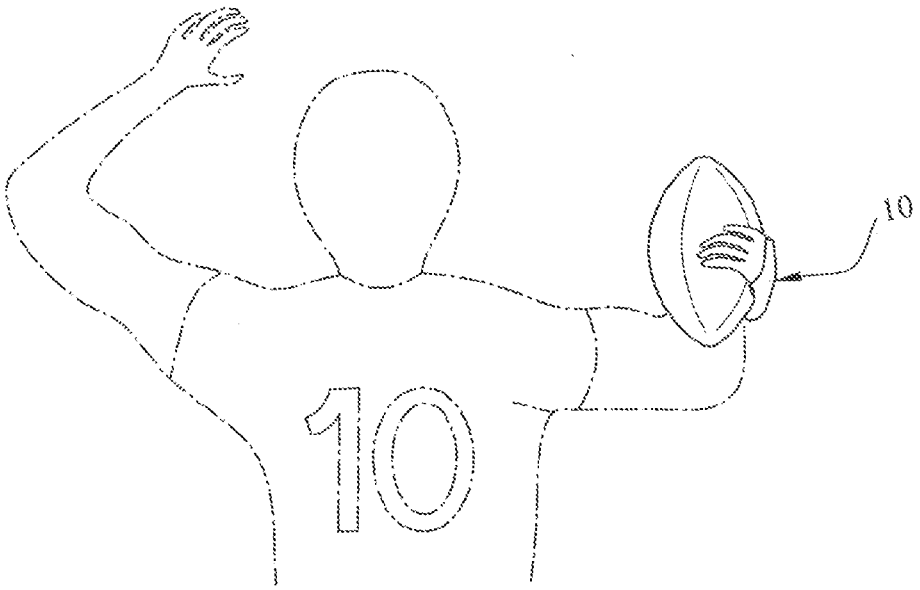
FIGS. 7A-7D are a sequence of perspective views showing a user throwing a football while wearing the training device.
Figure 7B:
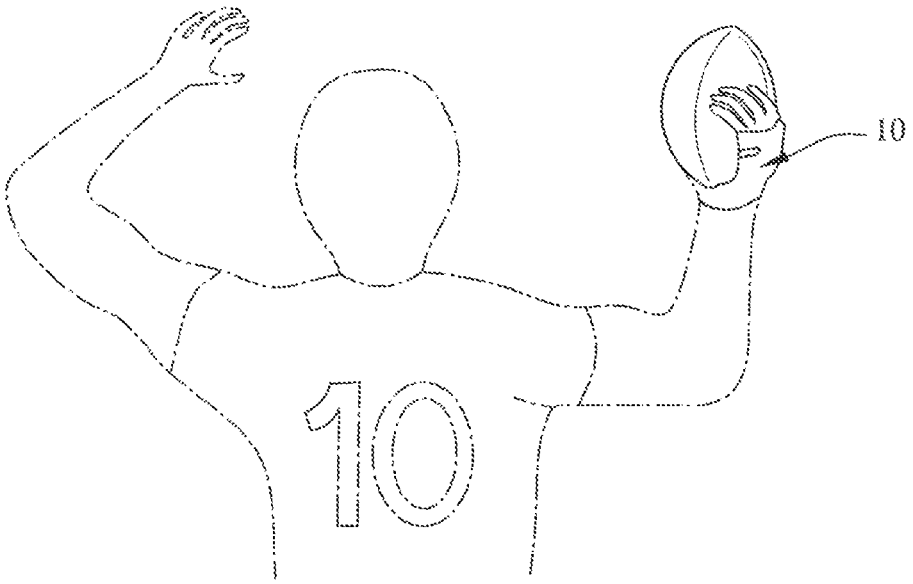
Figure 7C:
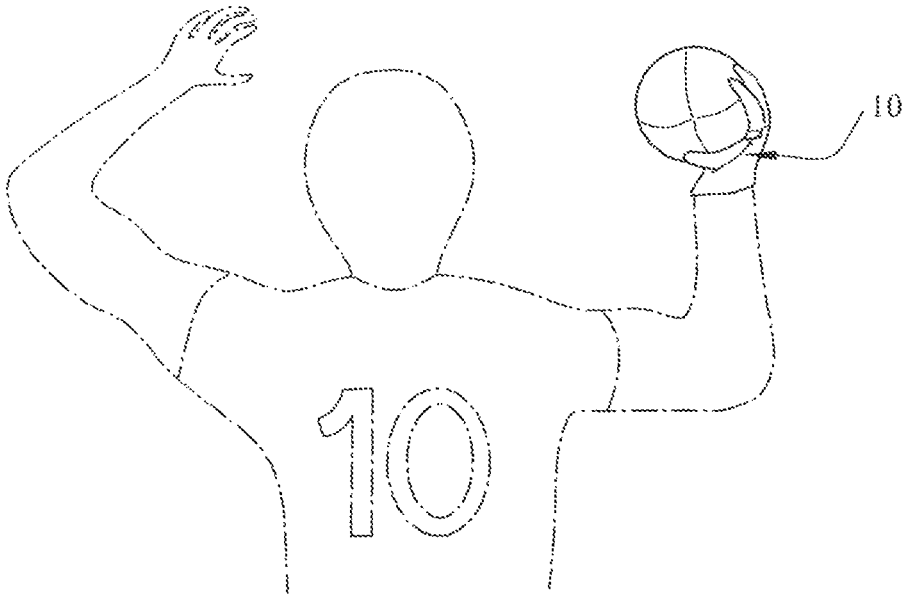
Figure 7D:
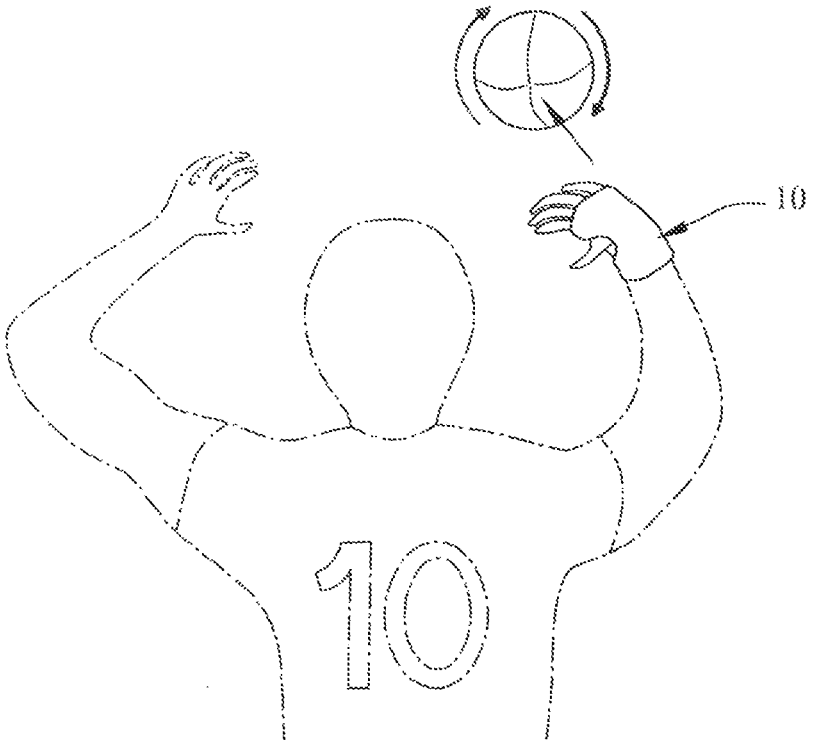

Referring to FIGS. 7A-7D, the football training throwing device is shown in operation. FIG. 7A illustrates the thrower in the cocking phase of the football throwing motion, wherein the thrower's arm reaches back, exhibiting maximal shoulder and elbow abduction, and creating an angle necessary for subsequent forward motion. During the cocking phase, the thrower's wrist does not naturally undergo flexion and is restricted from undergoing extension by the arched insert plate(s) 18. FIGS. 7B and 7C illustrates intermediate phases of the football throwing motion, wherein the thrower accelerates the football forward within his hand. During the intermediate acceleration phase, the thrower's wrist does not naturally undergo flexion and is restricted from undergoing extension by the arched insert plate(s) 18. FIG. 7D illustrates the follow-through phase of the football throwing motion, wherein the thrower releases the football as his hand continues to move forward. During the follow through phase, the thrower's wrist is permitted to naturally undergo flexion, but is restricted from undergoing extension by the arched insert plate(s) 18.

The preferred materials for the arched insert plate 18 include plastic, vinyl, or any other synthetic material that can be formed (e.g. molded) into an arched insert plate 18 sized to generally form to the back side of a user's wrist and having qualities that allow a user's wrist to bend backwards only when sufficient force is applied (i.e. if the user was to attempt to break his fall using his hands) when inserted into the receiving slot of a glove 12 worn by a user.

In a preferred embodiment of the training device 10, a padded spacer 22 is included on the palm portion of the glove 12. When throwing a football, it is ideal for a user to grasp the football using primarily his or her fingertips and to avoid contact between the user's palm and the football. The padded spacer 22 serves to space the user's palm away from the football, which is representative of proper placement of the football wherein the football may be grasped primarily by the user's fingertips.

While the present invention has been shown and described in accordance with several preferred and practical embodiments, it is recognized that departures from the instant disclosure are fully contemplated within the spirit and scope of the invention.

What is claimed is:

1. A training device for teaching proper football throwing motion, said training device in combination with a football comprising:

a glove member sized and configured to be worn on a portion of the hand and wrist of a user, and said glove member including a top side that is sized and configured to at least partially cover the dorsal side of the user's hand and wrist and a bottom side that is sized and configured to at least partially cover the palmar side of the user's hand and wrist;

a compartment on the top side of said glove member and a receiving slot providing access to said compartment;

at least one arched insert plate including a first side having a convex surface and an opposite second side having a concave surface, and said at least one arched insert plate being sized and configured to be inserted through the receiving slot and into said compartment such that the concave surface of said at least one arched insert plate faces towards the dorsal side of the user's hand and wrist;

said at least one arched insert plate being structured and disposed for permitting flexion of the user's wrist while restricting extension of the user's wrist in response to an extension force generated during the football throwing motion; and said at least one arched insert plate being structured and disposed for permitting extension of the user's wrist in response to an externally applied extension force that is greater than the extension force generated during the football throwing motion.

2. The training device as recited in claim 1 wherein said glove member further comprises a plurality of straps for securing said training device to the portion of the hand and wrist of the user.

3. The training device as recited in claim 2 wherein said glove member further comprises a hook portion of a hook and loop fastener on each of said plurality of straps and a loop portion of the hook and loop fastener on said glove member for adjustably fitting and securing said glove member to the portion of the hand and wrist of the user.

4. The training device as recited in claim 1 wherein said glove member is machine washable.

5. The training device as recited in claim 4 wherein said glove member is machine dryable.

6. The training device as recited in claim 1 wherein said glove member is at least partially comprised of an elastomeric material.

7. The training device as recited in claim 1 wherein said glove member further comprises a padded spacer on the bottom side of the glove member, and said padded spacer being structured and disposed for displacing a football held by the hand of the user from the palmar side of the user's hand.

8. The training device as recited in claim 1 wherein said glove member is formed of a flexible, water resistant and breathable material that allows air flow communication between the portion of the user's hand a wrist and an exterior atmosphere surrounding said glove member.

9. The training device as recited in claim 1 wherein said at least one arched insert plate is formed of vinyl.

10. A training device for teaching proper football throwing motion, said training device in combination with a football comprising:

a glove member sized and configured to be worn on a portion of the hand and wrist of a user, and said glove member including a top side that is sized and configured to at least partially cover the dorsal side of the user's hand and wrist and a bottom side that is sized and configured to at least partially cover the palmar side of the user's hand and wrist;

a plurality of straps for securing said training device to the portion of the hand and wrist of the user;

a hook portion of a hook and loop fastener on each of said plurality of straps and a loop portion of the hook and loop fastener on said glove member for adjustably fitting and securing said glove member to the portion of the hand and wrist of the user;

a compartment on the top side of said glove member and a receiving slot providing access to said compartment;

at least one arched insert plate including a first side having a convex surface and an opposite second side having a concave surface, and said at least one arched insert plate being sized and configured to be inserted through the receiving slot and into said compartment such that the concave surface of said at least one arched insert plate faces towards the dorsal side of the user's hand and wrist;

said at least one arched insert plate being structured and disposed for permitting flexion of the user's wrist while restricting extension of the user's wrist in response to an extension force generated during the football throwing motion; and said at least one arched insert plate being structured and disposed for permitting extension of the user's wrist in response to an externally applied extension force that is greater than the extension force generated during the football throwing motion.

11. The training device as recited in claim 10 wherein said glove member is machine washable.

12. The training device as recited in claim 11 wherein said glove member is machine dryable.

13. The training device as recited in claim 10 wherein said glove member is at least partially comprised of an elastomeric material.

14. The training device as recited in claim 10 wherein said glove member further comprises a padded spacer on the bottom side of the glove member, and said padded spacer being structured and disposed for displacing a football held by the hand of the user from the palmar side of the user's hand.

15. The training device as recited in claim 10 wherein said glove member is formed of a flexible, water resistant and breathable material that allows air flow communication between the portion of the user's hand a wrist and an exterior atmosphere surrounding said glove member.

16. A training device for teaching proper football throwing motion, said training device in combination with a football comprising:

a glove member sized and configured to be worn on a portion of the hand and wrist of a user, wherein said glove member is at least partially elastomeric for gripping close against the portion of the hand and wrist of the user to secure the glove member to the portion of the hand and wrist of the user, and said glove member including a top side that is sized and configured to at least partially cover the dorsal side of the user's hand and wrist and a bottom side that is sized and configured to at least partially cover the palmar side of the user's hand and wrist;

a compartment on the top side of said glove member and a receiving slot providing access to said compartment;

at least one arched insert plate including a first side having a convex surface and an opposite second side having a concave surface, and said at least one arched insert plate being sized and configured to be inserted through the receiving slot and into said compartment such that the concave surface of said at least one arched insert plate face towards the dorsal side of the user's hand and wrist;

said at least one arched insert plate being structured and disposed for permitting flexion of the user's wrist while restricting extension of the user's wrist in response to an extension force generated during the football throwing motion; and said at least one arched insert plate being structured and disposed for permitting extension of the user's wrist in response to an extension force greater than the extension force generated during the football throwing motion.

17. The training device as recited in claim 16 wherein said glove member is machine washable.

18. The training device as recited in claim 17 wherein said glove member is machine dryable.

19. The training device as recited in claim 16 wherein said glove member further comprises a padded spacer on the bottom side of the glove member, and said padded spacer being structured and disposed for displacing a football held by the hand of the user from the palmar side of the user's hand.

20. The training device as recited in claim 16 wherein said glove member is formed of a flexible, water resistant and breathable material that allows air flow communication between the portion of the user's hand a wrist and an exterior atmosphere surrounding said glove member.

* * * * *